US007308992B1

(12) United States Patent
Mineau et al.

(10) Patent No.: US 7,308,992 B1
(45) Date of Patent: Dec. 18, 2007

(54) SPRING-LOADED ACTUATOR CAP

(75) Inventors: Steven B. Mineau, Racine, WI (US); Ernst W. Tamm, Racine, WI (US); Allen D. Miller, Racine, WI (US); Scott W. Demarest, Caledonia, WI (US); Brian E. Healy, Hartland, WI (US); Anthony G. Volini, Oak Park, IL (US); Simon M. Conway, Burlington, WI (US); Nathan R. Westphal, Union Grove, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 438 days.

(21) Appl. No.: 10/941,791

(22) Filed: Sep. 15, 2004

(51) Int. Cl.
*B67D 5/06* (2006.01)

(52) U.S. Cl. ..... 222/182; 222/183; 222/402.1; 222/402.13; 222/402.24

(58) Field of Classification Search ..... 222/182–183, 222/321.8, 505, 402.1, 507, 402.13, 402.15, 222/402.21, 402.22, 402.23, 402.25, 162
See application file for complete search history.

(56) References Cited

U.S. PATENT DOCUMENTS

| | | | | |
|---|---|---|---|---|
| 2,575,124 | A | 11/1951 | Pollitt | 222/162 |
| 2,673,008 | A | 3/1954 | Ryan | 222/162 |
| 2,766,913 | A | 10/1956 | Wilshusen | 222/394 |
| 2,941,700 | A | 6/1960 | Gable | 222/394 |
| 3,127,065 | A | 3/1964 | Stevenson | 222/164 |
| 3,161,196 | A | 12/1964 | Berkow | 128/225 |
| 3,247,655 | A | 4/1966 | Jacob | 56/255 |
| 3,318,492 | A | 5/1967 | Haas | 222/402.11 |
| 3,404,814 | A | 10/1968 | Wakeman | 222/402.13 |
| 3,516,424 | A | 6/1970 | Eagle | 132/148 |
| 3,618,833 | A | 11/1971 | Webster | 222/402.22 |
| 3,648,905 | A | 3/1972 | Kauder | 222/402.21 |
| 3,739,941 | A | 6/1973 | Ostrwosky et al. | |
| 3,759,431 | A | 9/1973 | Vos | 222/402.22 |
| 3,760,988 | A | 9/1973 | Ostrowsky | 222/153 |
| 3,871,557 | A | 3/1975 | Smrt | 222/162 |
| 3,884,398 | A | 5/1975 | McLaughlin | 222/402.13 |
| 3,884,399 | A | 5/1975 | Matern | 222/402.13 |
| 3,888,392 | A | 6/1975 | Van Coney | |

(Continued)

FOREIGN PATENT DOCUMENTS

| | | |
|---|---|---|
| EP | 0641727 A2 | 8/1994 |

(Continued)

OTHER PUBLICATIONS

U.S. Appl. No. 11/007,070, Office Action dated Jun. 1, 2007.

(Continued)

*Primary Examiner*—Frederick C. Nicolas

(57) ABSTRACT

An actuator cap for a container of product includes a main peripheral wall surrounding a central discharge member. The central discharge member is oriented to discharge product axially. An actuator arm extends radially from the central discharge member and is axially deflectable to axially displace the discharge member. A pillar has a peripheral surface and is radially deflectable toward the central discharge member, and the pillar is deflectable relative to the main peripheral wall. In an actuating position of the discharge member, both the pillar and the actuator arm are deflected.

26 Claims, 14 Drawing Sheets

U.S. PATENT DOCUMENTS

| | | | | | |
|---|---|---|---|---|---|
| 3,907,175 | A | | 9/1975 | Haas | 222/402.13 |
| 3,915,353 | A | | 10/1975 | Haas | 222/402.1 |
| 3,946,911 | A | | 3/1976 | Morane et al. | 222/402.11 |
| 3,987,942 | A | | 10/1976 | Morane et al. | 222/402.15 |
| 4,013,231 | A | | 3/1977 | Van Veldhoven | 239/579 |
| 4,077,548 | A | | 3/1978 | Beard | 222/321 |
| 4,077,549 | A | | 3/1978 | Beard | 222/321 |
| 4,087,027 | A | | 5/1978 | Haas | 222/402.13 |
| 4,124,148 | A | | 11/1978 | Vieler et al. | 222/321 |
| 4,132,359 | A | | 1/1979 | Nozawa | 239/333 |
| 4,138,039 | A | | 2/1979 | Micallef | 222/321 |
| 4,170,316 | A | * | 10/1979 | LaBarbera | 220/799 |
| 4,186,855 | A | | 2/1980 | Edman et al. | 222/321 |
| 4,277,004 | A | | 7/1981 | Barlics | 222/402 |
| 4,378,081 | A | * | 3/1983 | van Lit | 222/402.13 |
| 4,826,054 | A | | 5/1989 | Frutin | 222/402.11 |
| 4,860,932 | A | | 8/1989 | Nagy | 222/402.1 |
| 5,139,180 | A | | 8/1992 | Lucas | 222/402.13 |
| 5,279,444 | A | | 1/1994 | Williams | 222/1 |
| 5,287,998 | A | | 2/1994 | Smrt | 222/402.1 |
| D347,263 | S | | 5/1994 | Phillips | D23/231 |
| 5,307,959 | A | | 5/1994 | Bedore et al. | 222/174 |
| 5,310,096 | A | | 5/1994 | Rogers et al. | 222/402.13 |
| 5,335,832 | A | | 8/1994 | De Laforcade | 222/402.13 |
| 5,358,147 | A | | 10/1994 | Adams et al. | 222/183 |
| 5,411,184 | A | | 5/1995 | Smrt | 222/402.13 |
| 5,503,303 | A | * | 4/1996 | LaWare et al. | 222/153.12 |
| 5,518,148 | A | | 5/1996 | Smrt | 222/174 |
| 5,702,036 | A | | 12/1997 | Ferrara, Jr. | 222/402.13 |
| 5,743,431 | A | | 4/1998 | Brattesani | 222/1 |
| 5,875,926 | A | | 3/1999 | Schwartz | 222/79 |
| 5,915,599 | A | | 6/1999 | Takahashi | 222/402.13 |
| 5,971,226 | A | | 10/1999 | Goncalves | 222/321.6 |
| 5,992,707 | A | | 11/1999 | Gaichuk | 222/402.13 |
| 6,003,739 | A | | 12/1999 | Bartlett et al. | 222/402.1 |
| 6,004,056 | A | | 12/1999 | De Laforcade | 401/190 |
| 6,299,032 | B1 | | 10/2001 | Hamilton | 222/402.15 |
| 6,321,742 | B1 | | 11/2001 | Schmidt et al. | 126/38 |
| 6,340,103 | B1 | | 1/2002 | Scheindel et al. | 222/402.15 |
| 6,386,397 | B2 | | 5/2002 | Brotspies et al. | 222/321.6 |
| 6,390,336 | B1 | | 5/2002 | Orozco | 222/162 |
| 6,543,653 | B2 | | 4/2003 | Lamboux | 222/321.8 |
| 6,551,001 | B2 | | 4/2003 | Aberegg et al. | 401/190 |
| D474,403 | S | | 5/2003 | Fahy et al. | D9/448 |
| 6,588,631 | B2 | | 7/2003 | Sanchez | 222/402.13 |
| 2004/0028458 | A1 | | 2/2004 | Heathcock et al. | 401/190 |
| 2004/0188473 | A1 | | 9/2004 | Groh et al. | 222/402.13 |
| 2004/0222245 | A1 | | 11/2004 | Marroncles | 222/402.13 |

FOREIGN PATENT DOCUMENTS

| | | |
|---|---|---|
| WO | WO 01/26995 | 4/2001 |
| WO | WO03/024836 | 3/2003 |

OTHER PUBLICATIONS

U.S. Appl. No. 11/006,930, Office Action dated Jun. 1, 2007.

* cited by examiner

SPRING-LOADED ACTUATOR CAP

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to actuating apparatus, and more particularly to actuator caps that are placed on containers and used to dispense product from the containers.

2. Description of the Background of the Invention

Various apparatus for dispensing product from a container or reservoir of product have been developed. Smrt U.S. Pat. No. 5,287,998 discloses an actuator fitted to a container and including an axially extending passage therethrough for discharging product. The actuator includes a pair of wings that extend transversely from the actuator. The container may be moved axially within a device such that the wings bear against a surface defining a passage, thereby discharging product through the passage.

Brotspies et al. U.S. Pat. No. 6,386,397 discloses a spray bottle grip used with a nasal spray bottle. The grip is coupled to a reciprocating nozzle of the spray bottle, and two arms extend downwardly along the spray bottle. The arms include finger flanges that provide an ergonomic means of reciprocating the nozzle to dispense product from the spray bottle.

Haas U.S. Pat. No. 3,318,492 discloses a disc-shaped actuator attached to a nozzle of a container. A user may depress the actuator with her finger to dispense product from the container.

Scheindel et al. U.S. Pat. No. 6,340,103 discloses a handle extending along a container body. When a user pulls the handle toward the container body, a portion of the handle pushes downwardly upon a nozzle portion of the container to dispense product from the container.

Micallef U.S. Pat. No. 4,138,039 discloses a container having a vertically reciprocating tubular pump. A cap is fitted to the container and includes an actuator button extending from a sidewall of the cap. Movement of the actuator button in a direction toward the sidewall of the cap is translated into perpendicular reciprocating movement of the pump.

Other patents disclose devices having a container of product disposed at a first end of a rod and having a trigger mechanism at a second end of the rod wherein a user may actuate the container from a distance. Discharging product from a distance can be an advantage for many purposes, such as accessing hard-to-reach places or perhaps for discharging an insecticide into a hornet nest without placing oneself too close to the nest. Smrt U.S. Pat. No. 5,518,148 discloses a device where an actuating rod has a trigger on a first end and a container on a second end. Pulling the trigger moves the actuating rod longitudinally such that the second end of the rod moves a bell crank, which in turn, moves an additional rod that actuates a valve on the container. Aberegg et al. U.S. Pat. No. 6,551,001, assigned to the assignee of the present application and the disclosure of which is incorporated by reference herein, discloses a cleaning device having a trigger at a first end of a rod and a mop cleaning head and a container at a second end of the rod. Pulling the trigger moves a pivot link, which in turn actuates a valve of the container, thereby discharging product from the container onto the surface to be cleaned by the mop cleaning head.

Adams et al. U.S. Pat. No. 5,358,147, assigned to the present assignee and also incorporated herein by reference, discloses a container of air freshener inserted into a shroud. The shroud includes a nozzle that is fitted over a valve stem of the container. The combination of the container and the shroud is placed within a housing. When a user wishes to spray air freshener into ambient air, the user pushes the housing, which in turn pushes the shroud and the valve stem to dispense the air freshener out of the housing.

SUMMARY OF THE INVENTION

In accordance with one aspect of the present invention, an actuator cap for a container of product includes a main peripheral wall surrounding a central discharge member. The central discharge member is oriented to discharge product axially. An actuator arm extends radially from the central discharge member and is axially deflectable to axially displace the discharge member. A pillar has a peripheral surface and is radially deflectable toward the central discharge member, and the pillar is deflectable relative to the main peripheral wall. In an actuating position of the discharge member, both the pillar and the actuator arm are deflected.

A further aspect of the present invention comprehends an actuator cap for a container of product that includes a centrally disposed actuator member oriented to discharge product axially and a main peripheral wall. A wall portion is radially deflectable toward the actuator member. An axially deflectable actuator arm has an end extending from the actuator member in a direction from the actuator member toward the main peripheral wall wherein the cap assumes first, second, and third positions. In the first position, the wall portion is in a first deflected state and the actuator arm is deflected to an actuating position. In the second position, the wall portion is in a second deflected state in which the wall portion is deflected less than in the first deflected state and the actuator arm is in a non-actuating position. In the third position, both the wall portion and the actuator arm are in an undeflected state.

In accordance with a further aspect of the present invention, an actuator cap for a container of product includes a main body having a flexible region that is radially deflectable toward an axial centerline of the cap. The flexible region deflects in response to a first force to a first extent and in response to a second force greater than the first force deflects to a second extent greater than the first extent. A centrally disposed actuator member is oriented to discharge product axially. An actuator arm extends radially from the actuator member in a direction from the actuator member toward the flexible region. The actuator arm deflects to an actuating position in response to the second force but does not deflect to an actuating position in response to the first force.

Other aspects and advantages of the present invention will become apparent upon consideration of the following detailed description.

DETAILED DESCRIPTION OF THE DRAWINGS

Figure 1A:
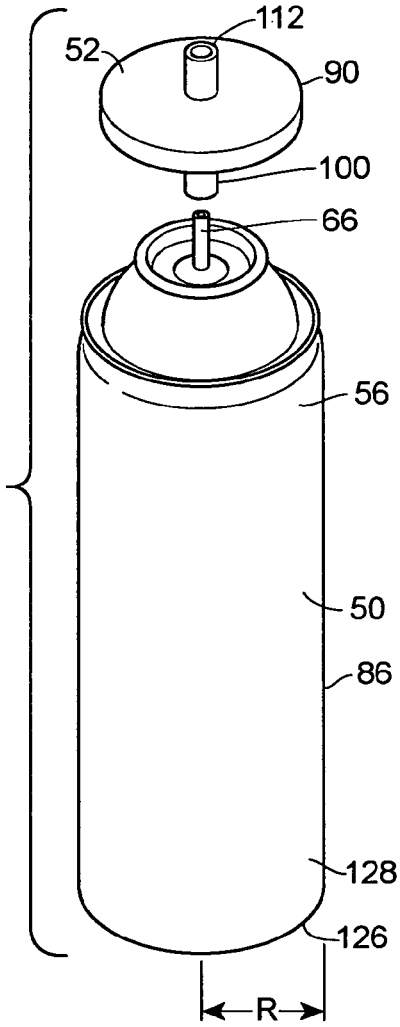
FIG. 1A is an exploded isometric view of a container and valve actuating apparatus.
Figure 2:
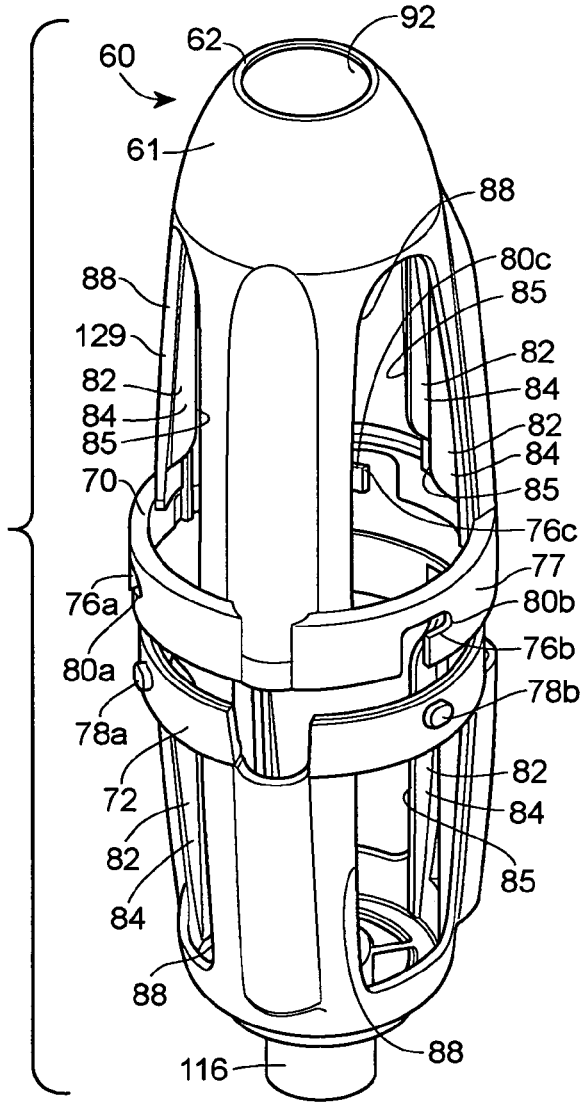
FIG. 2 is an exploded isometric view of a housing into which the container of FIG. 1A may be placed.
Figure 1B:
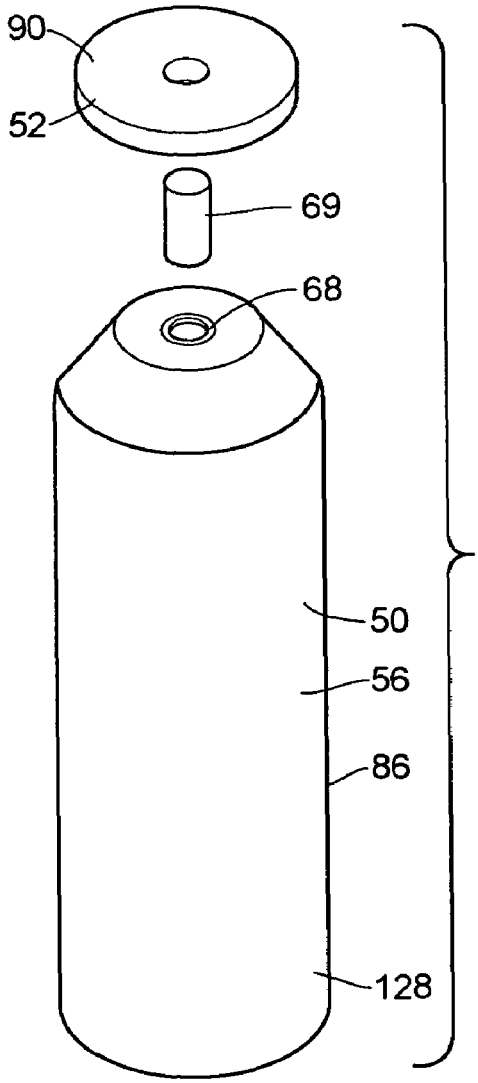
FIG. 1B is an exploded isometric view showing a container having a female-type receiver valve.
Figure 1C:
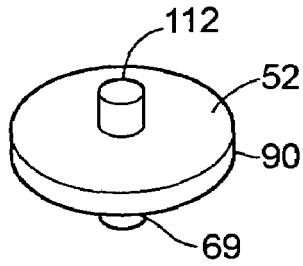
FIG. 1C is an isometric view of valve actuating apparatus.

FIG. 1A illustrates a container 50 and a valve actuating apparatus 52 actuable to dispense product from the container 50. The container 50 includes a main container body 56 that contains product. Referring to FIG. 2, a housing 60 is provided, in which the container 50 may be placed. The housing 60 includes a wall 61 that decreases in cross sectional size, tapering to a discharge opening 62. The discharge opening 62 has a cross sectional size greater than a radius R of the container 50. The container 50 includes a valve stem 66 that actuates a valve (not shown) disposed within the container body 56, and product flows from the valve stem 66 in a direction substantially parallel to an axial dimension of the container 50. The valve stem 66 could be either a vertically depressible valve stem or a tilt valve stem. As will be appreciated hereinafter, if a tilt valve stem is utilized such stem could also alternatively be depressed vertically without tilting to dispense product therethrough. Referring to FIG. 1B, one could substitute the valve stem 66 with a female valve 68 that receives a suitable insertion tube 69. As shown in FIG. 1C, the insertion tube 69 could be integral with or secured to the valve actuating apparatus 52. Alternatively, the valve actuating apparatus 52 could be separable from the insertion tube 69. Similarly, it should be evident that the valve actuating apparatus 52 could be separable from the valve stem 66 or could be secured in fixed relation thereto or could be integral therewith. It should be evident that the valve actuating apparatus 52 could include any suitable apparatus that may be displaced to release product from the container 50. Referring again to FIG. 2, the housing 60 may include first and second wall portions 70, 72 that may be joined together to house the container 50. The portion 70 may include three bayonet slots 76*a*-76*c* disposed on an end 77 of the portion 70 and equally spaced from one another by 120 degrees. To join the portions 70, 72, a user inserts pins 78*a*-78*c* carried by an end 79 of the portion 72 into the slots 76*a*-76*c* and provides a relative rotation of the portions 70, 72 to seat the pins 78*a*-78*c* within recessed regions 80*a*-80*c* of the slots 76.

Either of the portions 70, 72 may include protrusions 82 such as guide fins 84 having edges 85 that abut an exterior surface 86 of the container 50 when the container 50 is placed therein to center the container 50 within the housing 60. Either of the portions 70, 72 may include elongate openings or windows 88 that allow a user to see the container 50 when the container is disposed within the housing 60. The windows 88 further provide an advantage in that the user may see written directions or graphics disposed on the container 50.

Figure 1D:
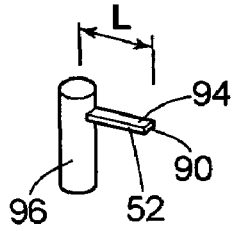
FIG. 1D is an isometric view of a valve stem having an arm extending therefrom.
Figure 3:
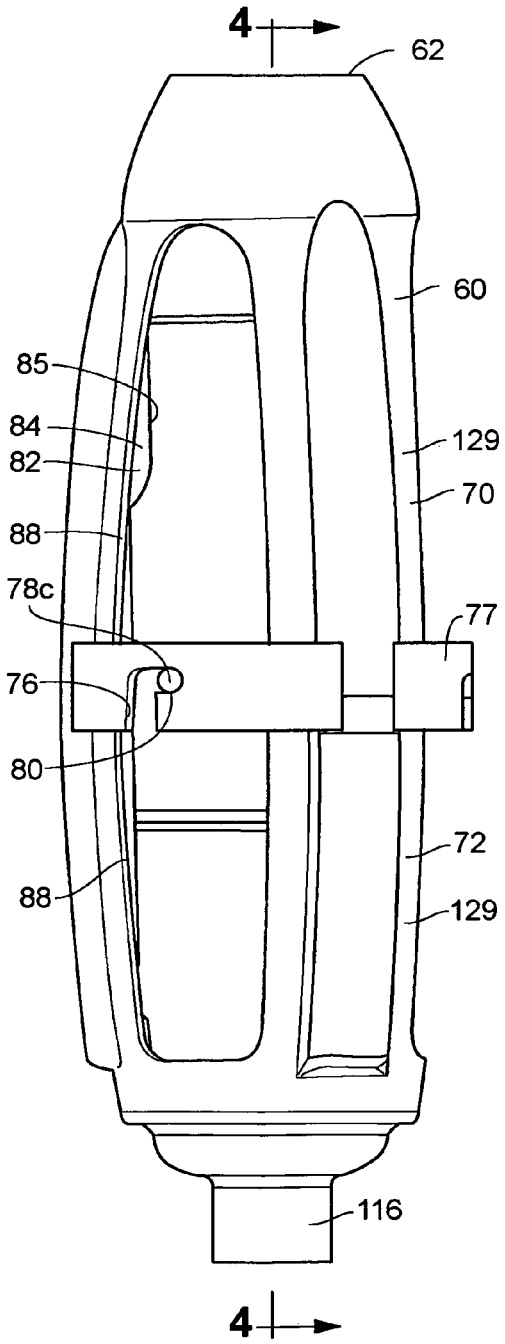
FIG. 3 is a side elevational view of the housing of FIG. 2.
Figure 4:
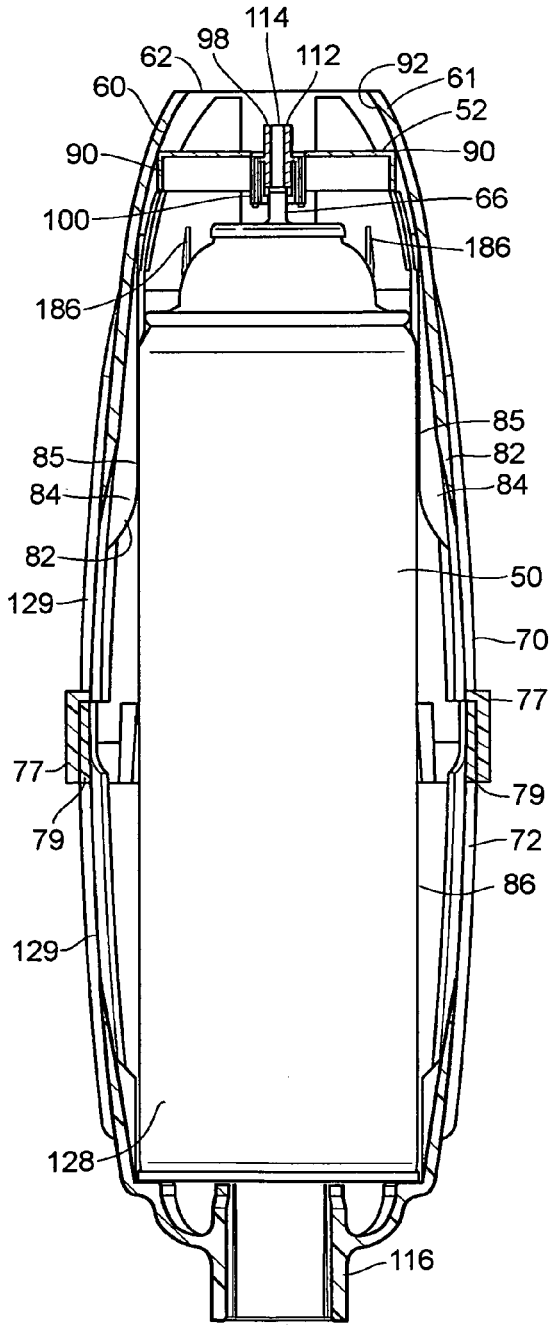
FIG. 4 is a sectional view taken generally along the lines 4-4 of FIG. 3 further illustrating the container of FIG. 1 in elevation.
Figure 5:
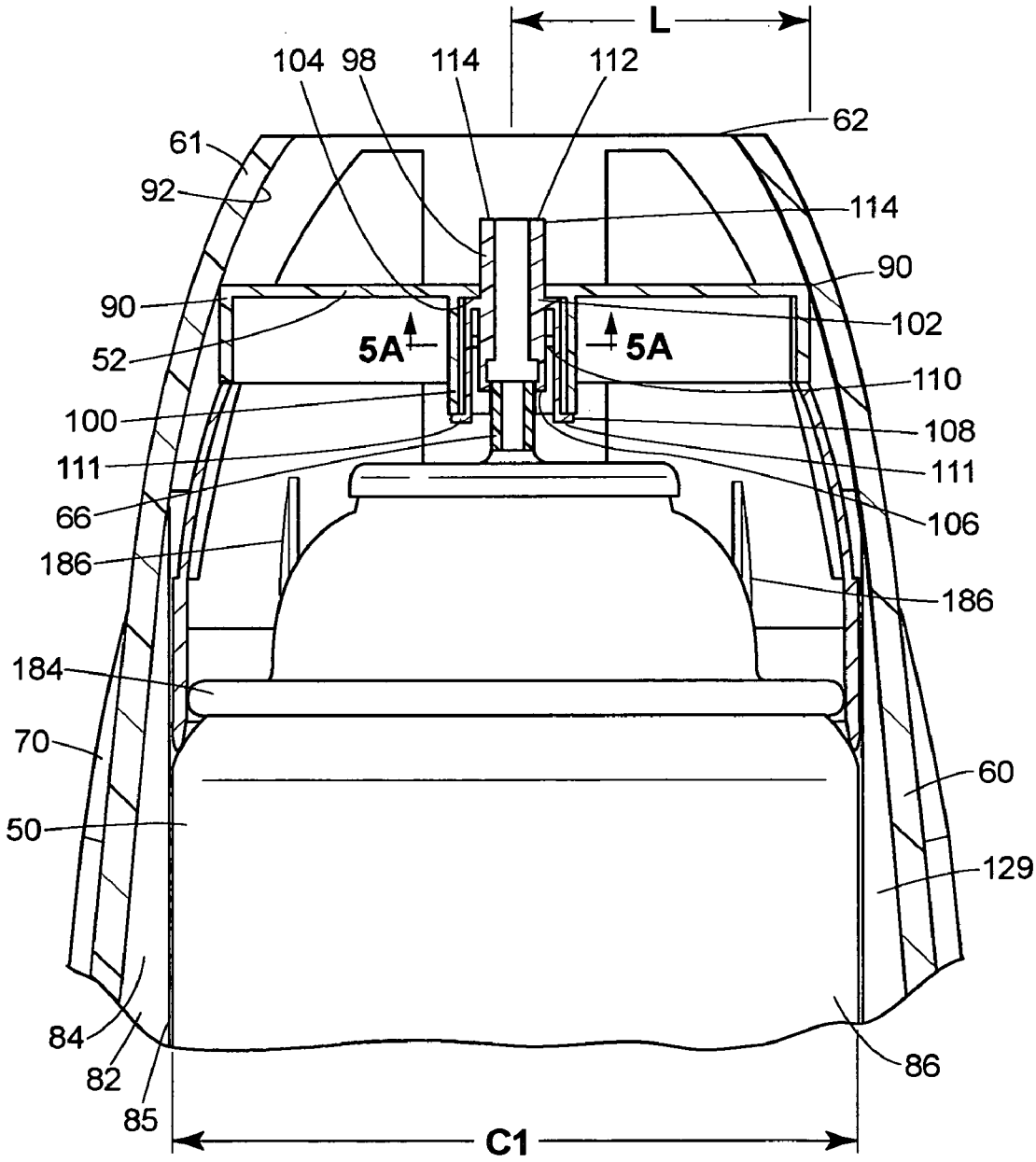
FIG. 5 is an enlarged fragmentary view of FIG. 4.

Referring to FIGS. 4 and 5, the valve actuating apparatus 52 extends in a direction transverse to a longitudinal dimension of the container 50. The valve actuating apparatus 52 has a length L defined between a center of the valve stem 66 and an outer peripheral surface 90 of the valve actuating apparatus 52. As seen in FIG. 5, the length L is selected relative to the inner dimensions of the wall 61 such that the outer peripheral surface 90 is disposed in interfering relationship with the wall 61. Relatively moving the container 50 and the housing 60 such that the main body 56 of the container 50 and the discharge opening 62 are moved toward each other causes the outer peripheral surface 90 to contact a surface 92 of the wall 61, thereby displacing the valve actuating apparatus 52 and dispensing product out of the discharge opening 62. It should be appreciated that the valve actuating apparatus 52 could be of any suitably shaped structure. For example, referring to FIG. 1D, the valve actuating apparatus 52 could include a single arm 94 having at least a portion of length L and extending from a tilt-type valve stem 96.

Figure 5A:
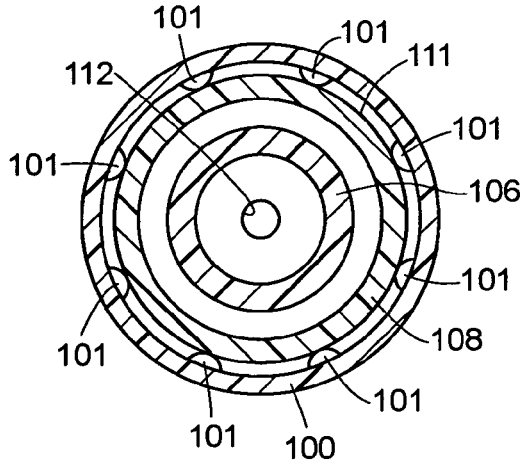
FIG. 5A is an enlarged sectional view taken generally along the lines 5A-5A of FIG. 5.
Figure 6:
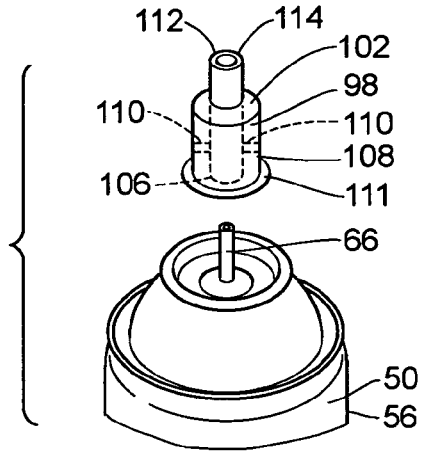
FIG. 6 is a fragmentary exploded isometric view illustrating a nozzle that may be fitted to a valve stem.
Figure 7:
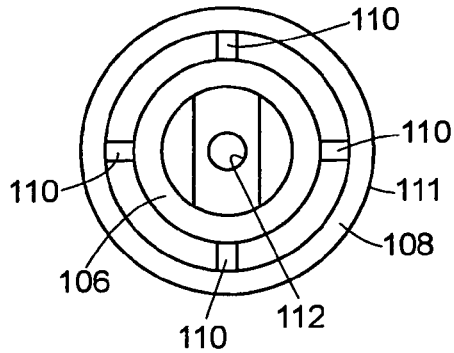
FIG. 7 is an enlarged bottom elevational view of the nozzle of FIG. 6.

Referring to FIGS. 5-7, a nozzle 98 may be fitted to the valve stem 66 and the nozzle 98 may be fitted within a bore defined by a circumferential wall 100 of the valve actuating apparatus 52. The nozzle 98 includes a shoulder 102 that abuts a bearing surface 104 of the valve actuating apparatus 52. Referring to FIG. 5A, the circumferential wall 100 may include ribs 101 extending therefrom that engage the wall 108. In addition, the wall 100 may be tapered to facilitate insertion of the nozzle 98 therein. The nozzle 98 may include an inner circumferential wall 106 defining a flow passage and surrounded by an outer circumferential wall 108 connected to the inner circumferential wall 106 by radially extending members 110. The nozzle 98 may also have a flange 111 that abuts a lower periphery of the circumferential wall 100 as seen in FIG. 5. An outlet 112 is located at a discharge orifice 114 of the nozzle 98. Various conventional internal features can be selected so as to impart a desired spray characteristic to product discharged from the nozzle 98. Nozzles such as nozzle 98 are commercially available from Summit Packaging Systems, Inc. of Manchester, N.H.

Figure 8:
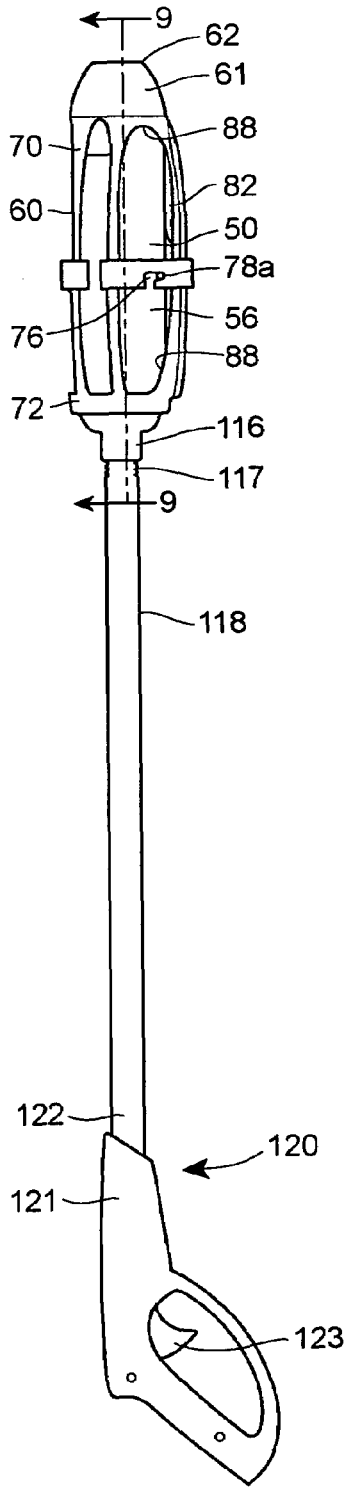
FIG. 8 is a side elevational view showing a rod and trigger mechanism in combination with the housing of FIG. 3.
Figure 9:
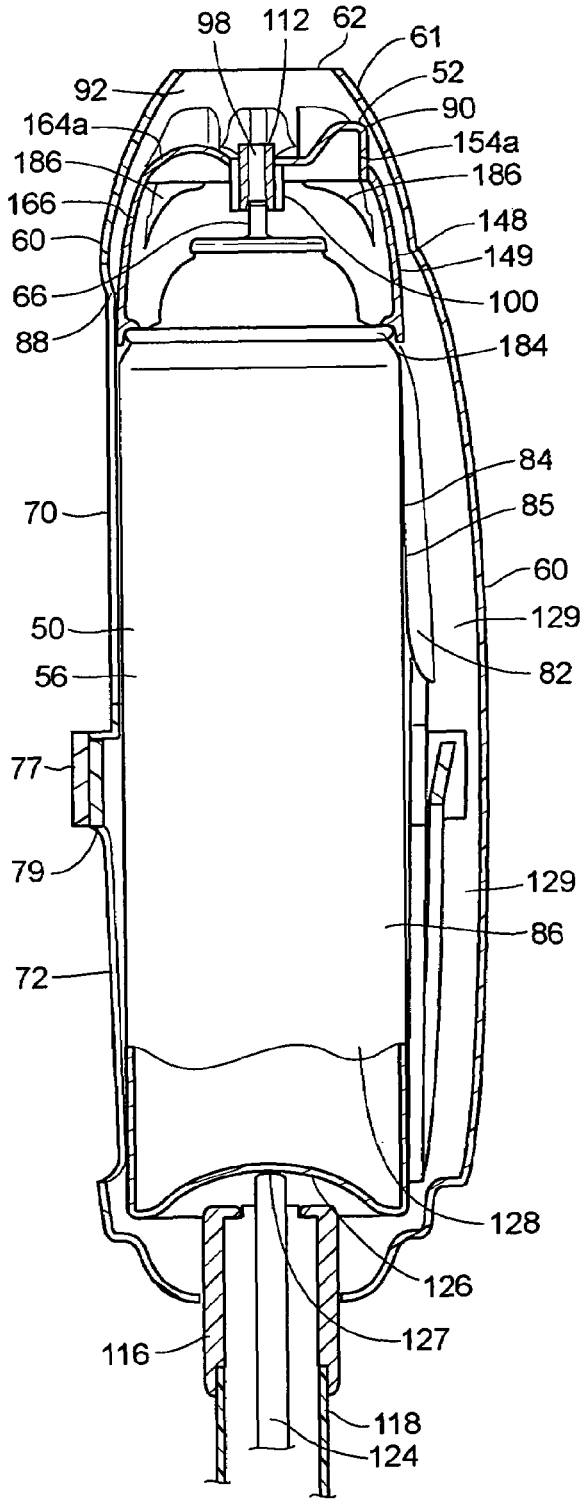
FIG. 9 is a fragmentary partial sectional view taken generally along the lines 9-9 of FIG. 8.

Referring to FIGS. 8 and 9, the housing 60 includes a sleeve 116 attached by any suitable means to a first end 117 of a hollow tube 118 of a rod and trigger mechanism 120. A handle assembly 121 is secured by any suitable means to a second end 122 of the hollow tube 118. Pulling a trigger 123 of the handle assembly 121 advances a push rod 124 (FIG. 9) disposed within the tube 118 against a bottom surface 126 of the container 50, thereby advancing the valve actuating apparatus 52 toward the discharge opening 62 to dispense product from the housing 60. If necessary or desirable, an end 127 of the push rod 124 may be shaped and/or fitted with a plate or other member to distribute forces more evenly across the bottom surface 126 of the container 50. Further, if desired, rather than moving the container 50 relative to the housing 60 by using the rod and trigger mechanism one could move the container 50 and/or the housing 60 relative to one another by hand to dispense product.

Referring again to FIG. 5, a main region 129 of the wall portions 70 and 72 may have an inner cross sectional size C1 of about 66 mm, and thus the container 50 could have a cross sectional size of up to about 66 mm. In this regard, while a range of sizes is available for the container 50 one might wish to provide a container sized at or near maximum to provide a maximum useful life for the container 50 given the available space within the housing 60. One could select any suitable size for the discharge opening 62, such as a cross sectional size of about 34 mm, and suitable values of L might range between about 18 mm and about 33 mm to provide the above-described interfering relationship. A preferred value for L is about 25 mm.

The product stored within the container body 56 could be any of a broad variety of products such as an air freshener, an insect control agent, a hair spray, a cleaning agent, a polishing agent, a fragrance, or other any other product stored in a container. Further, the product may be pressurized by a suitable propellant disposed within the container 50.

Figure 10:
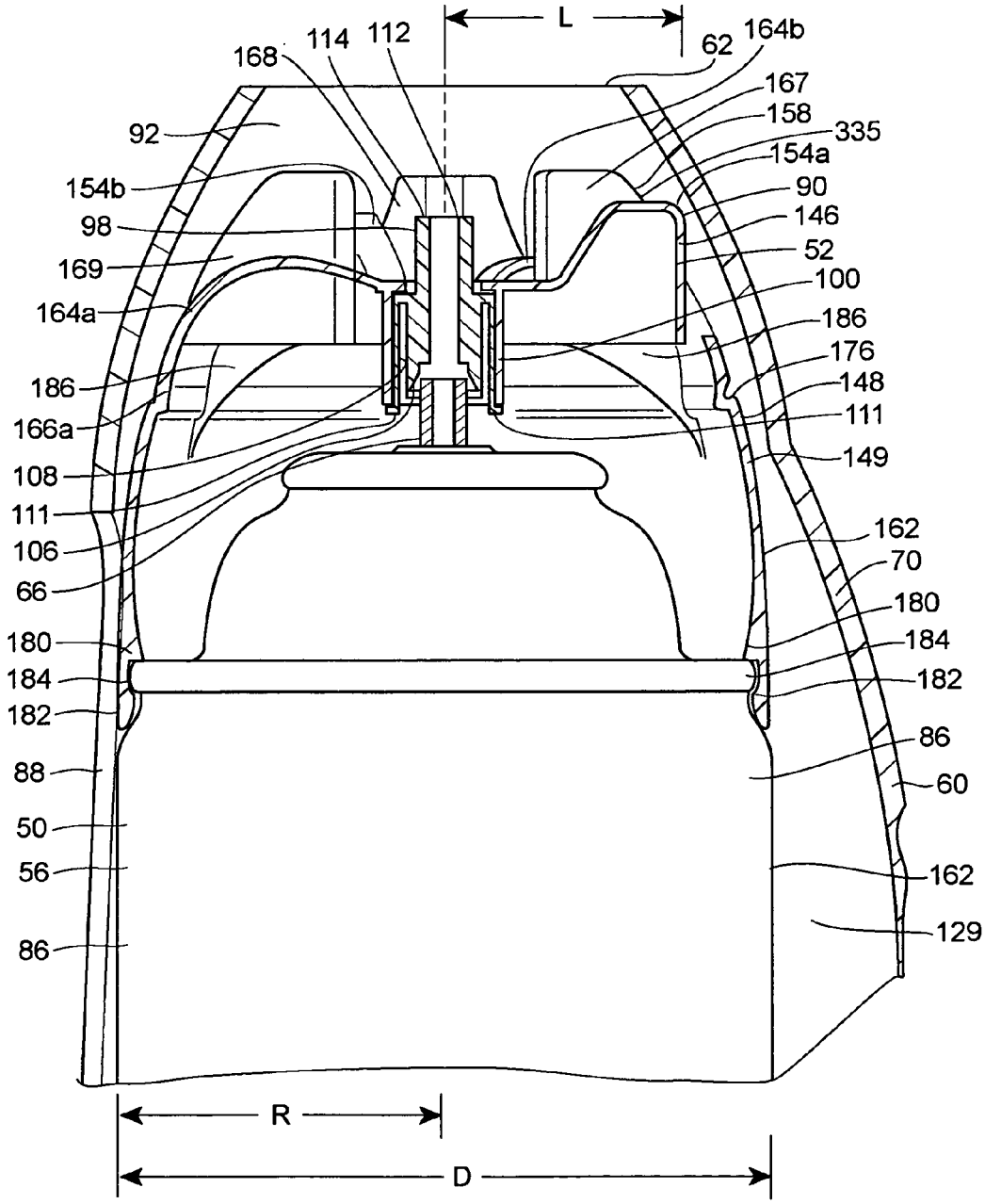
FIG. 10 is an enlarged fragmentary view of a portion of the apparatus of FIG. 9.
Figure 11:
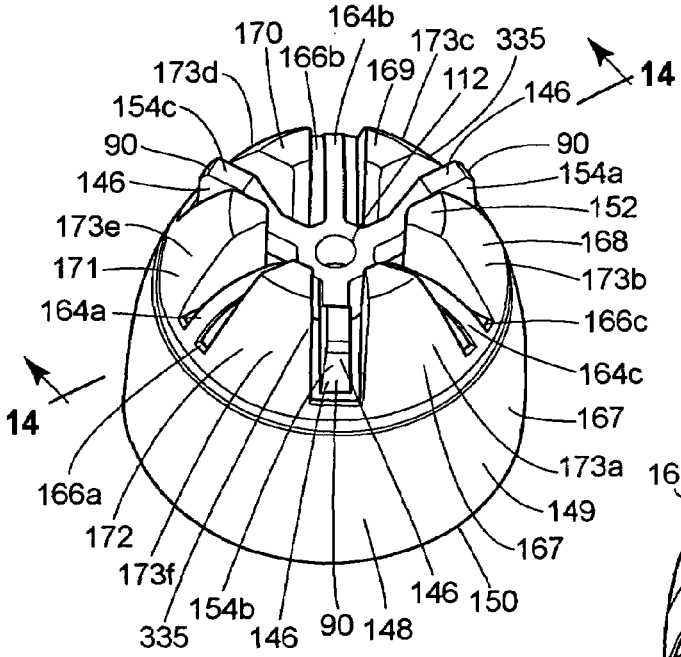
FIGS. 11 and 12 are top and bottom isometric views, respectively, of the actuator cap of FIG. 10.
Figure 12:
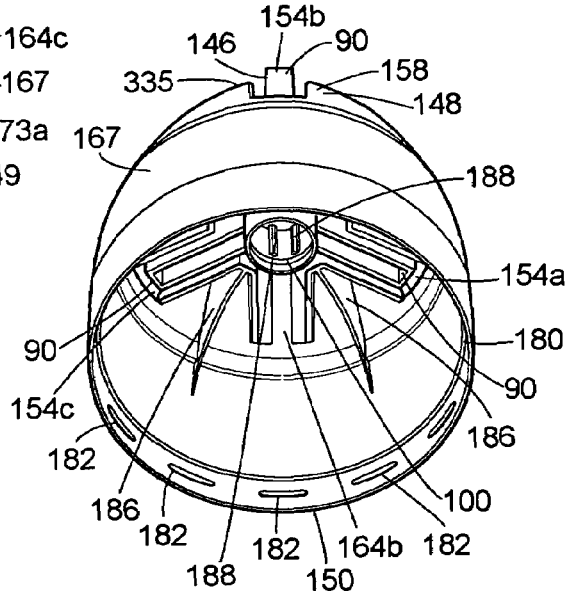
Figure 13:
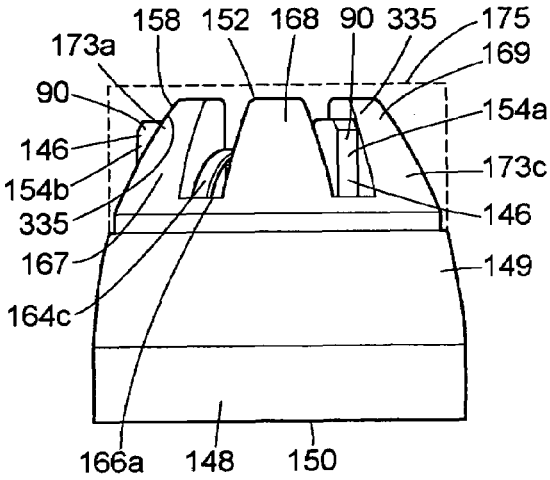
FIG. 13 is a side elevational view of the actuator cap of FIG. 9 showing an optional cover in phantom lines.
Figure 14:
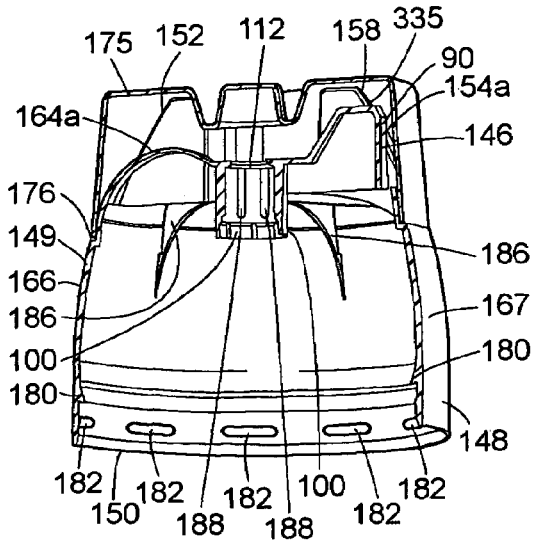
FIG. 14 is a sectional view taken generally along the lines 14-14 of FIG. 11.

FIGS. 10-14 illustrate a further embodiment of valve actuating apparatus 146 wherein structures common to previous embodiments are assigned like reference numerals. FIG. 11 shows the valve actuating apparatus 146 incorporated in an actuator cap 148 that may be fitted onto the container 50. A main peripheral wall 149 of the cap 148 decreases in cross sectional size along an axial dimension defined between first and second ends 150, 152, tapering from the end 150 to the end 152. Referring also to FIG. 10, a first arm 154*a* is integral with the wall 100 surrounding the nozzle 98 and has a length L as measured between the surface 90 and the center of the valve stem 66. The center of the valve stem 66 is substantially coincident with the center of the actuator cap 148. FIG. 10 shows that a portion of the inner circumferential wall 106 of the nozzle 98 may be tapered to facilitate insertion of the valve stem 66 therein. The arm 154*a* extends in a direction transverse to the axial dimension such that the surface 90 is disposed beyond a portion 158 of the main wall 149. When the cap 148 is fitted to the container 50, one or both of the cap 148 and the container 50 define an outermost periphery 162, and the arm 154*a* preferably (although not necessarily) does not extend beyond the outermost periphery 162. A flexible strap member 164*a* extends from the circumferential wall 100 in a direction opposite the arm 154*a*. Referring to FIG. 11, additional arms 154*b*, 154*c* may be provided, and the arms 154*a*-154*c* are spaced apart by 120°. Strap members 164*b*, 164*c* extend in diametrically opposite directions to the arms 154*b*, 154*c*. The arms 154*a*-154*c* are cantilevered from the circumferential wall 100, and the arms 154 and the straps 164 form a monolithic structure attached to the main wall 149 only at areas 166*a*-166*c* of the main wall 149. The straps 164 and the arms 154 are disposed in recesses defined between upright portions 167-172 of the cap 148. The actuator cap 148 provides a useful centering function in that exterior surfaces 173*a*-173*f* of the upright portions 167-172, respectively, maintain the point of discharge 112 of the actuator cap 148, best seen in FIGS. 10 and 11, in a centrally located position relative to the discharge opening 62, thereby minimizing the potential for product impingement against the surface 92 of the wall 61. Referring to FIGS. 13 and 14, a cover 175 may be placed over the cap 148 to prevent inadvertent actuation during shipment.

FIG. 14 shows that the actuator cap 148 may include a circumferential inwardly-tapered flange 180 and a plurality of spaced apart inwardly-directed beads 182. As shown in FIG. 10, the flange 180 and the beads 182 are snap fitted over a rim 184 of the container 50 such that the rim 184 is captured between the flange 180 and the beads 182 to retain the actuator cap 148 on the container 50.

FIGS. 12 and 14 show arcuate gussets or strengthening ribs 186 that provide rigidity to the wall portions 167-172. FIG. 14 shows ribs 188 that may be provided within the circumferential wall 100 to engage the exterior surface of the valve stem 66 or of the nozzle 98 fitted to the valve stem 68. The ribs 188 aid in centering the nozzle 98 and also provide slightly flexible contact points between the circumferential wall 100 and the nozzle 98, accommodating minor variances in the size of either part.

Figure 15:
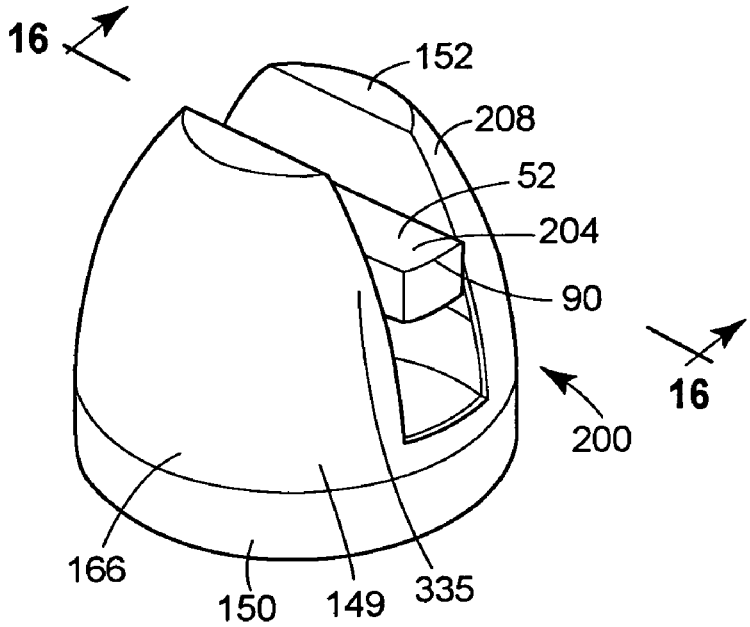
FIG. 15 is an isometric view of a second actuator cap.
Figure 16:
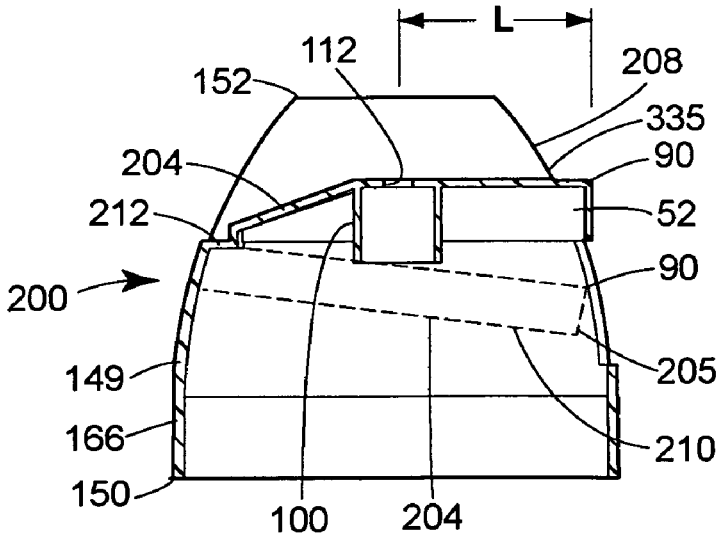
FIG. 16 is a sectional view taken generally along the lines 16-16 of FIG. 15.

FIGS. 15 and 16 show an alternative actuator cap 200 having an arm in the form of a lever member 204. The lever member 204 extends in a direction transverse to the axial dimension and terminates at the outer peripheral surface 90, which is disposed beyond a portion 208 of the wall 149 of the cap 200. However, the lever member 204 preferably does not extend transversely beyond an outer diameter of the first end 150. The lever member 204 is pivotable about a hinge portion 212 connected to the wall 149. The surface 90 of the lever member 204 traverses an arcuate path as the lever member 204 is pivoted downwardly. At a point represented by a phantom line 210, the surface 90 does not extend beyond any portion of the wall 149 such that the lever member 204 cannot move downwardly more than a particular distance owing to the fact that the lever member 204 is shielded from the housing surface 92 by the wall 149. Therefore, when the cap 200 is disposed on the container 50 it is not possible to deflect the lever member 204, and hence the valve stem 66, more than the particular distance. Comparing the cap 148 of FIGS. 10-14 to the cap 200, it should be noted that the plurality of arms 154 of the cap 148 radiating from the circumferential wall 100 provide a plurality of the surfaces 90 at circumferentially spaced positions. Providing a plurality of the surfaces 90 at spaced apart positions, such as 180°, ensures substantially axial reciprocating movement of the valve stem 66, rather than tilting movement, potentially minimizing product discharge against the wall 61 of the housing 60.

FIGS. 17-27 illustrate actuator cap embodiments designed to reduce the likelihood of inadvertent dispensing that might result from a user inadvertently shaking or jostling the housing 60 with the container 50 disposed therein.

Figure 17:
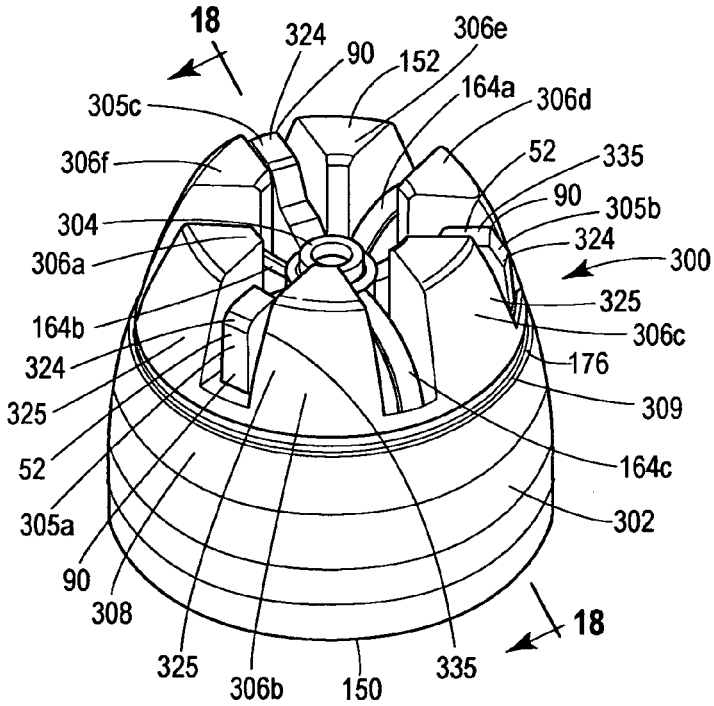
FIG. 17 is an isometric view of a third actuator cap.
Figure 18:
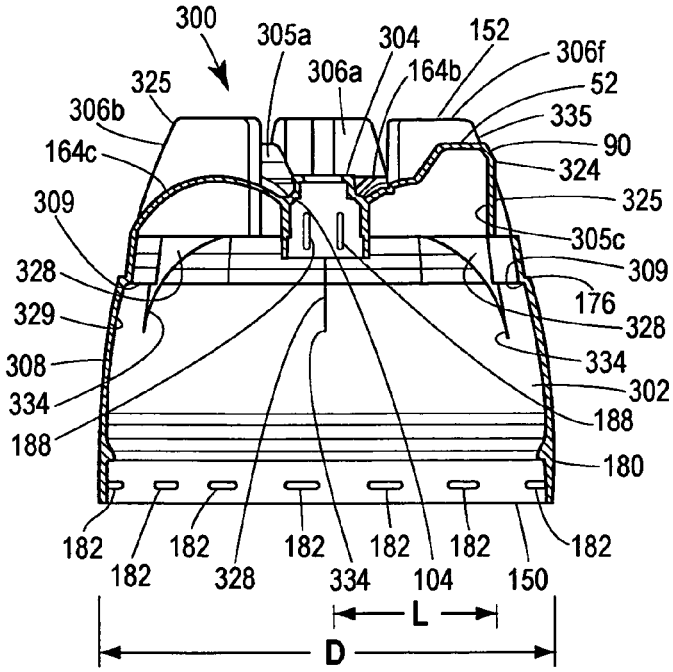
FIG. 18 is a sectional view taken generally along the lines 18-18 of FIG. 17.

Referring to FIG. 17, an actuator cap 300 has a main body 302, a centrally disposed adapter 304 securable to the valve stem 66 shown in FIG. 1, and actuator arms 305*a*-305*c* extending from the adapter 304 and cantilevered therefrom. First through sixth flexible pillars 306*a*-306*f* are provided, which may be similar or identical in shape to the upright portions 168-172 of FIGS. 10-14. The pillars 306*a*-306*f* extend from a main peripheral wall 308 of the main body 302. As shown in FIG. 18, the pillars 306 are cantilevered from the wall 308, attached to the wall 308 at a hinge point 309. The pillars 306 are capable of being deflected radially inwardly toward the central adapter 304 about the hinge point 309. During such deflection, the pillars 306 tip inwardly about the hinge point 309, bowing toward the central adapter 304.

Figure 19A:
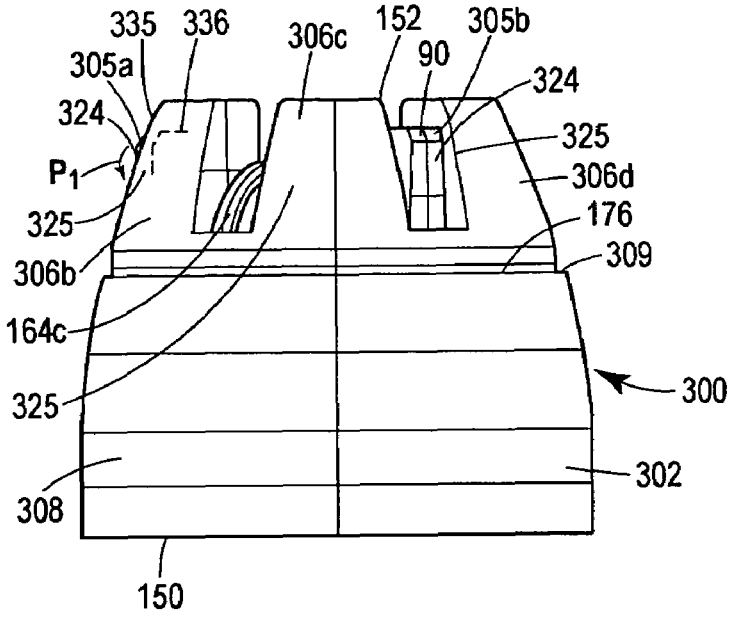
FIG. 19A is a side elevational view of the cap of FIG. 17 shown in an undeflected condition.
Figure 19B:
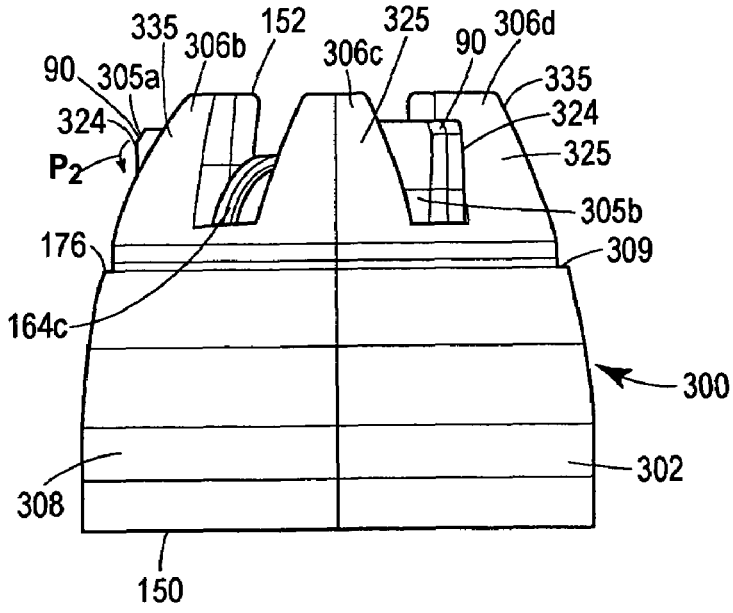
FIG. 19B is a side elevational view of the actuator cap of FIG. 17 showing the actuator cap in a deflected condition.
Figure 20:
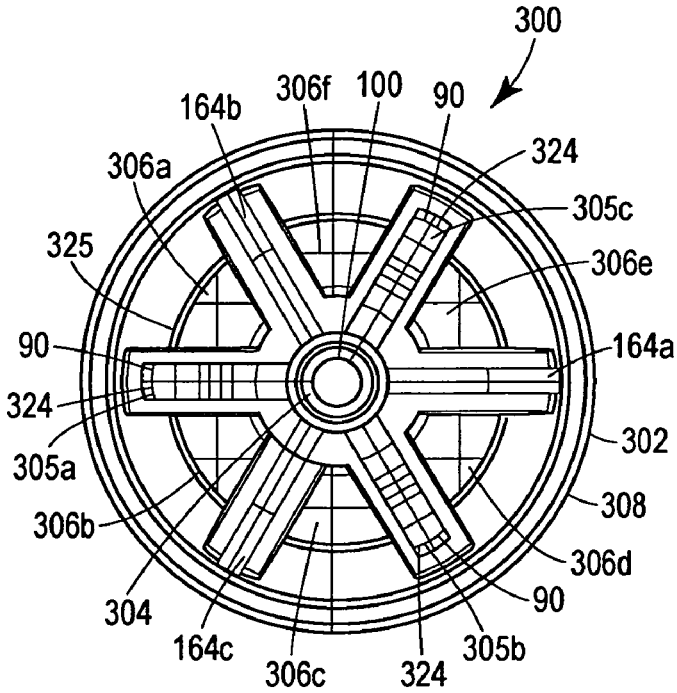
FIG. 20 is a plan view of the actuator cap of FIG. 17.
Figure 21:
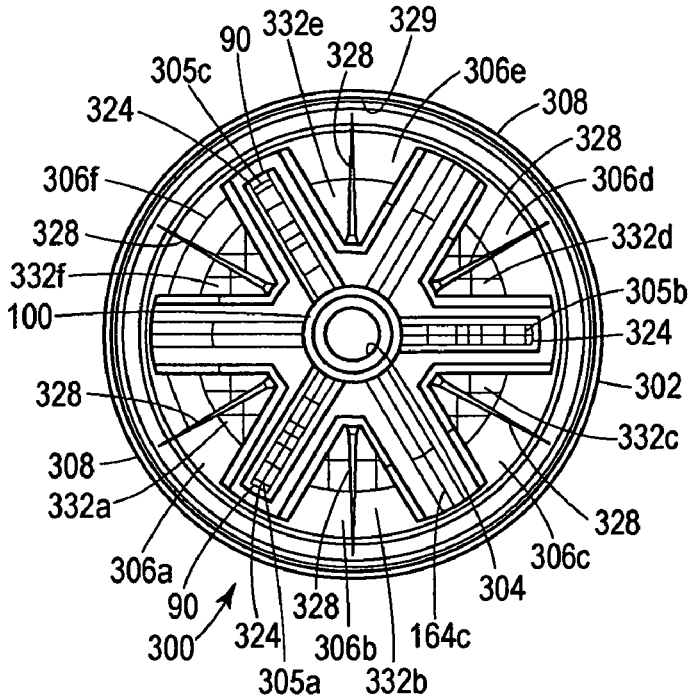
FIG. 21 is a bottom elevational view of the actuator cap of FIG. 17.
Figure 23:
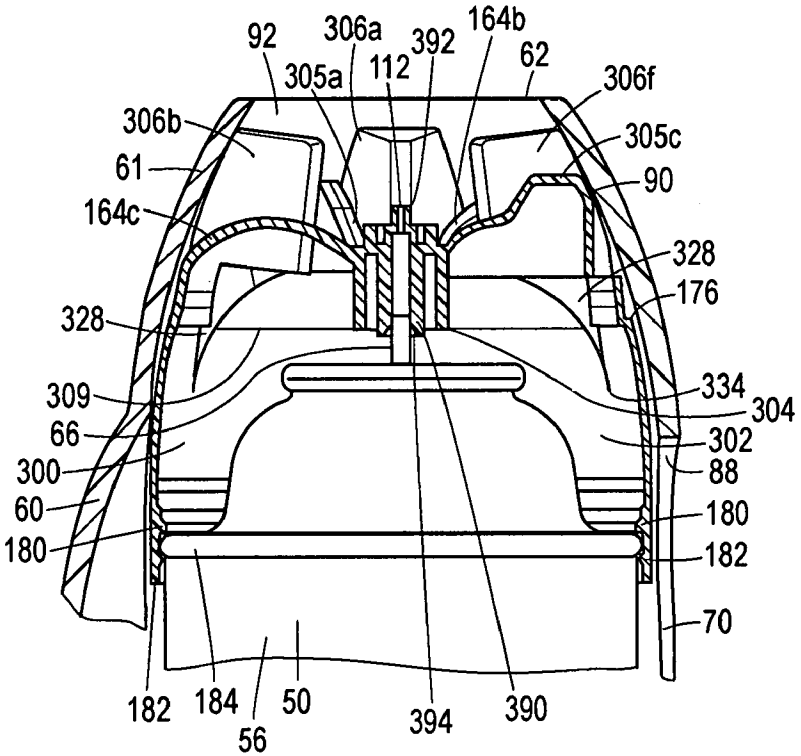
FIG. 23 is a view similar to FIG. 22, but showing the container advanced axially toward the discharge opening of the housing.

As discussed hereinbelow, deflection of the pillars 306 is necessary to allow for the actuator arms 305 to be deflected sufficiently to an actuating position thereof. In this regard, an actuating position is achieved when the central adapter 304 is axially displaced a sufficient distance to effect dispensing of product from the container 50. As shown in FIG. 23, the central adapter 304 is secured to the valve stem 66, and the actuating position is achieved when the valve stem 66 is axially displaced a sufficient distance into the container 50 to dispense product. FIG. 19B illustrates a deflection state of the cap 300 in which the pillars 306 are deflected but the actuator arms 305 are not deflected. The deflection shown in FIG. 19B might result if one were to squeeze the pillars 306 together by hand without deflecting the actuator arms 305. While this deflection state shown in FIG. 19B would not result from moving the container 50 within the housing 60, this view may nonetheless be instructive for understanding why the pillars 306 must be deflected in order for the adapter 304 to be displaced to the actuating position thereof. In this regard, FIG. 19A shows a path portion P1 traversed by an end surface 324 of the actuator arms 305. If one were to make the flexible pillars 306 rigid and immobile, then a surface 325 of the pillars 306 at a lower extreme of the path portion P1 would shield the arms 305 from further displacement against the housing surface 92. However, because the pillars 306 are deflectable as shown in FIG. 19B, the end surface 324 may traverse a larger path P2 when a sufficient force deflects the pillars 306. FIG. 23 shows the pillars 306 deflected toward the central adapter 304 and the valve stem 66 axially displaced into the container 50. The pillars 306 may have a resilient bias outward away from the central adapter 304. In order to axially displace the central adapter 304 a sufficient distance to the actuating position thereof, an amount of force must be applied that is sufficient to overcome the bias of the pillars 306, and thus move the pillars 306 to allow sufficient deflection of the actuator arms 305 to the actuating position thereof.

Referring to FIGS. 18, 21, 22, and 23, strengthening ribs 328 may be provided. The ribs 328 connect an internal surface 329 (FIG. 18) of the peripheral wall 308 to internal surfaces 332*a*-332*f* (FIG. 21) of the pillars 306. The pillars 306 are hollow, and the ribs 328 bisect the hollow pillars 306. During deflection of the pillars 306, each of the pillars 306 moves unitarily. Referring specifically to FIG. 18, a lower edge 334 of the ribs 328 may be positioned sufficiently close to the hinge point 309 such that the ribs 328 need not substantially flex during deflection of the pillars 306.

Comparing the cap 300 as shown in FIG. 18 to any of the embodiments shown in FIGS. 10-16, it should be noted that the outermost surfaces 90 of the actuator arms 305 of FIG. 18 extend a lesser distance outside the cap 300 beyond a surface 335 than the various actuating arms shown in FIGS. 10-16, such as the actuator arms 154 (FIGS. 10-14), or the lever member 204 (FIG. 16). However, although the actuator arms 305 extend outwardly a lesser distance relative to the surface 335, the actuator arms 305 still define a length L which must be sufficient so that the outermost surfaces 90 of the actuator arms 305 may contact the housing surface 92. In this regard, the length L as shown in FIG. 18 may have any suitable value such as greater than about ¼ of a diameter D of the cap 300 measured at the end 150. Of course, the length L may be alternatively expressed as greater than about ½ the radius R (the container radius R seen in FIG. 22) of the container 50 to which the cap 300 is affixed.

It should be noted that in the undeflected state shown in FIG. 19A, the actuator arms 305*a*-305*c* need not extend outside of the cap 300 beyond the surface 335. For example, referring to FIG. 19A, the end surfaces 324 of the actuator arms 305 could be disposed at the position of a phantom line 336. With such an arrangement, the end surfaces 324 of the actuator arms 305*a*-305*c* would be disposed inside of the actuator cap 300 prior to deflection of the pillars 306, but upon sufficient deflection of the pillars 306 would come into contact with the housing surface 92. It should be further noted that the actuator arms 305 could alternatively be dimensioned such that the end surfaces 324 are flush with the surface 335 prior to deflection of the pillars 306. Irrespective of whether the surfaces 324 are positioned inside or outside the cap 300 or flush with the surface 335, the extent of axial deflection of the actuator arms 305 against the surface 92 may be increased by radial deflection of the pillars 306 toward the adapter 304.

Figure 22:
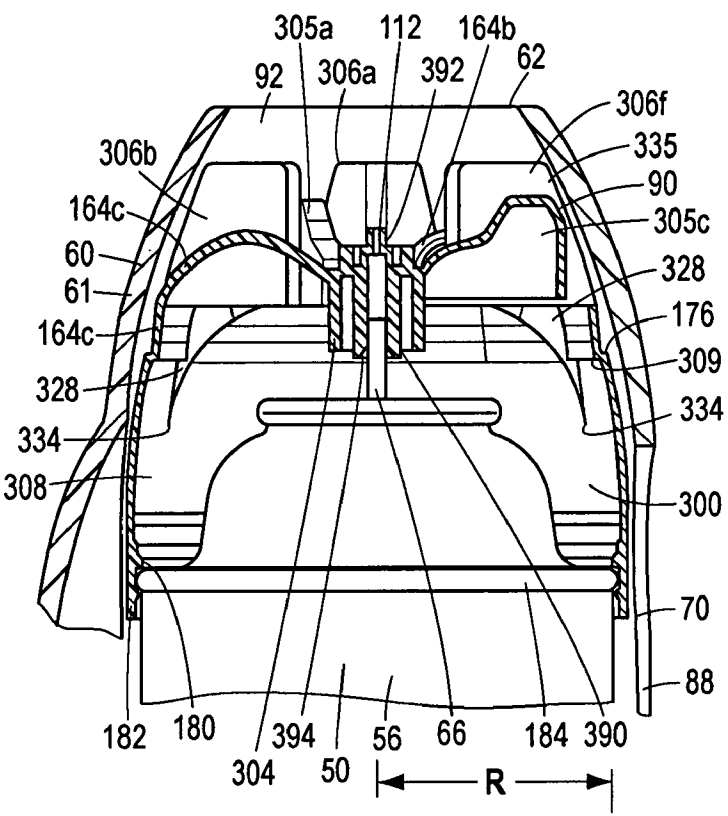
FIG. 22 is a fragmentary sectional view of the housing of FIG. 1 further illustrating the container of FIG. 1 in elevation and an actuator cap similar to the cap of FIG. 17 in section.
Figure 25:
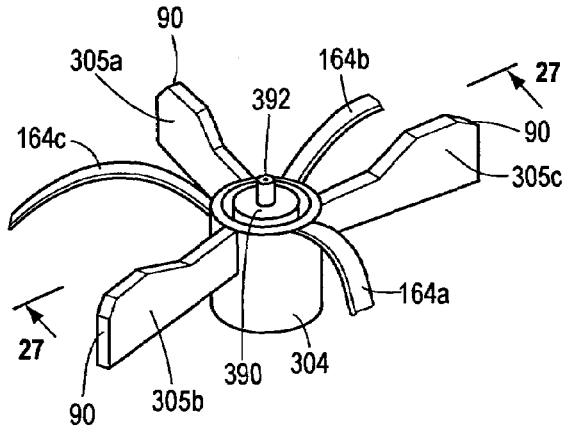
FIG. 25 is a fragmentary isometric view of a portion of the cap of FIG. 17 further illustrating the cap having an integral nozzle member.
Figure 26:
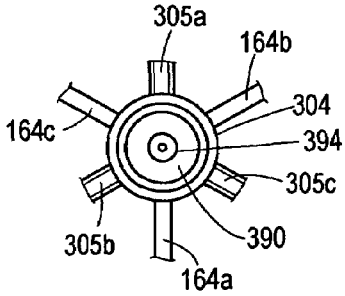
FIG. 26 is a bottom elevational view of a portion of the cap of FIG. 17.
Figure 27:
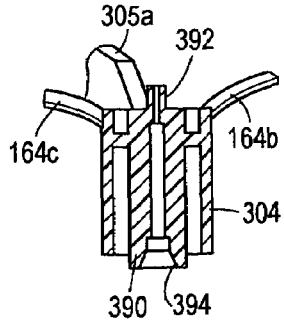
FIG. 27 is a fragmentary sectional view taken generally along the lines 27-27 of FIG. 25.

Referring to FIGS. 22 and 23, providing a relative movement of the container 50 toward the discharge opening 62 as described hereinabove depresses the valve stem 66 into the container 50 causing discharge of product out of the discharge opening 62 as described hereinbelow. Upon deflection of the pillars 306*a*-306*f* against the surface 92, continued movement of the cap 300 toward the discharge opening 62 axially deflects the actuator arms 305*a*-305*c* toward the container 50, thereby axially displacing the adapter 304. When the adapter 304 is sufficiently displaced to the actuating position thereof, the valve (not shown) of the container 50 opens and product dispenses from the housing 60. The resistance to movement of the arms 305 and the relative dimensioning of the pillars 306 and the arms 305 are such that deflection of the pillars 306 must occur before the actuator arms 305 can be displaced to the actuating position. Referring also to FIGS. 25-27, the adapter 304 may include an integral nozzle member 390 having a spray tip 392. Referring to FIG. 27, the nozzle member 390 may have a tapered surface 394 to facilitate fitting the valve stem 66 within the nozzle member 390.

Because the pillars 306 must be deflected in order for dispensing to occur, a sufficient amount of external mechanical force must act upon the actuator cap 300 to overcome the resistance provided by the pillars 306. In this regard, this resistance of the pillars 306 against movement provides a reactive force against forces directing the container 50 toward the discharge opening 62, such that this reactive force must be overcome before dispensing may occur. This reactive force is advantageous in that low force levels may be insufficient to overcome same to dispense product from the housing 60. For example, such low force levels may occur from a user jostling the housing 60 while walking or manipulating the housing 60 or may arise as a user shakes the housing 60 to mix the contents of the container 50. Such jostling could cause the cap 300 to be in a condition where the pillars 306 are slightly deflected and the actuator arms 305 are either undeflected or deflected to a lesser extent than the actuating position thereof. Ideally, the reactive force provided by the pillars 306 prevents inadvertent dispensing until such time as the user intentionally applies sufficient force, thereby radially deflecting the pillars 306 and axially deflecting the actuator arms 305 to the actuating position thereof. Thus, the user can pull the trigger 123 shown in FIG. 8 to intentionally dispense product, while inadvertent dispensing is avoided.

Figure 24:
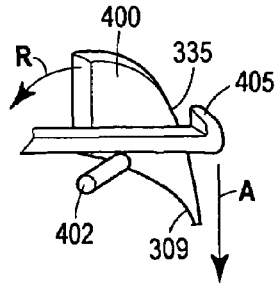
FIG. 24 is a diagrammatic and fragmentary isometric view of an alternative pillar and actuator arm.

Referring to FIG. 24, an alternative pillar 400 could include a rod 402 or other structure extending therefrom into the deflection path of an actuator arm 405, similar or identical to the actuator arms 305. Axial deflection of the actuator arm 405 in the direction of an arrow A pushes the actuator arm 405 against the rod 402, thereby moving the pillar 400. With the design of FIG. 24, moving the actuator arm 405 moves the pillar 400, and any force applied directly to the arm 405 must be sufficient to overcome the resistance to movement of the pillar 400 in order for the actuator arm 405 to reach an actuating position thereof.

The foregoing embodiments may provide one or more of the following advantages.

First, because the valve actuating apparatus 52, such as the arm 305, has a sufficiently large value of L, preferably having any suitable value greater than about one half the container radius R (or, stated another way, one quarter the diameter D), the valve actuating apparatus 52 is usable with the housing 60 to dispense product therefrom even though the discharge opening 62 is large. (As noted above, the cross sectional size of the discharge opening 62 is greater than the container radius R.) Containers lacking an actuating apparatus of the length L as defined previously are not usable with the housing 60. This may be useful because containers lacking the required valve actuating apparatus 52 may not be designed for use with the housing 60 or the housing 60 may not be marketed for use with a particular container of product that lacks the valve actuating apparatus 52. For example, the housing 60 may be marketed for use with a container of a specific type of insecticide sold with the valve actuating apparatus 52. In addition, a longer L value may be advantageous from a manufacturing tolerance standpoint because it may be easier to control tolerances of L for a large valve actuating apparatus rather than a small valve actuating apparatus having a smaller tolerance range. A further advantage of the large discharge opening 62 and large value of L is that contact near the outlet 112 is avoided. Because the wall 61 contacts the outer peripheral surface 90 at the distance L from the orifice of the valve stem 66, the potential for product obstruction or impingement is minimized. This feature could be especially advantageous for some products that fan out while discharging from the container 50 as the product gets farther away from the container 50. The large cross sectional size of the wall 61 would accommodate such fanning out while minimizing product impingement or deposition thereupon. A further advantage of the large discharge opening 62 is that the surface 92 of the wall 61 may be easily manually accessed for cleaning. Regarding the embodiment of FIGS. 15-16, because the length L is selected relatively long, the lever arm 204 has significant mechanical advantage at least according to this embodiment. A further optional advantage of the large value of L is that the valve actuating apparatus 52 might be easily displaced by hand if a user removes the container 50 from the housing 60 and manually displaces same. In this regard, the relative large value of the length L allows the user to maintain her hands away from product discharging from the container 50 in the event of such manual actuation. Also, the large size of the discharge opening 62 may require less material to construct the housing 60, and hence less cost.

INDUSTRIAL APPLICABILITY

The foregoing embodiments are useful for dispensing a variety of products such as insecticides, cleaning products, air treatment products (e.g., air fresheners), or other products.

Numerous modifications to the present invention will be apparent to those skilled in the art in view of the foregoing description. Accordingly, this description is to be construed as merely exemplary of the inventive concepts taught herein and is presented for the purpose of enabling those skilled in the art to make and use the invention and to teach the best mode of carrying out same. The exclusive rights to all modifications which come within the scope of the appended claims are reserved.

We claim:

1. An actuator cap for a container of product, comprising:

a main peripheral wall surrounding a central discharge member wherein the central discharge member is oriented to discharge product axially;

an actuator arm extending radially from the central discharge member and axially deflectable to axially displace the central discharge member;

a pillar having a peripheral surface and radially deflectable toward the central discharge member and wherein the pillar is deflectable relative to the main peripheral wall;

wherein movement of the actuator arm moves the pillar; and wherein in an actuating position of the central discharge member both the pillar and the actuator arm are deflected.

2. The actuator cap of claim 1, wherein a distance measured between an outermost peripheral surface of the actuator arm and an axial centerline of the cap is greater than one-quarter the diameter of an end of the cap for fitting to the container.

3. The actuator cap of claim 1, in combination with the container of product wherein a distance measured between an outermost peripheral surface of the actuator arm and an axial centerline of the cap is greater than one-quarter the diameter of a body of the container.

4. The actuator cap of claim 1, further comprising an additional actuator arm.

5. The actuator cap of claim 1, further comprising an additional pillar.

6. The actuator cap of claim 1, wherein the pillar is connected to the main peripheral wall and wherein the pillar pivots about the main peripheral wall.

7. The actuator cap of claim 1, in combination with the container of pressurized product wherein product discharges from the container when the discharge member of the actuator cap is in the actuating position.

8. The actuator cap of claim 7, in combination with a housing having a housing wall that tapers to a discharge opening and wherein the discharge opening has a cross sectional size larger than a radius of the container and wherein the arm is disposed in interfering relationship with the wall.

9. The actuator cap of claim 5, wherein the pillars are biased radially away from the central discharge member.

10. The actuator cap of claim 1, wherein in a non-actuating position an outermost surface of the arm is flush with the peripheral surface of the pillar.

11. The actuator cap of claim 1, wherein in a non-actuating position an outermost surface of the arm is radially inset from the peripheral surface of pillar.

12. The actuator cap of claim 1, wherein in a non-actuating position an outermost surface of the arm extends exteriorly beyond the peripheral surface of the pillar.

13. The actuator cap of claim 1, wherein the actuator arm is movable independently of the pillar.

14. An actuator cap for a container of product, comprising:

a centrally disposed actuator member oriented to discharge product axially;

a main peripheral wall and a wall portion radially deflectable toward the actuator member; and an axially deflectable actuator arm having an end extending from the actuator member in a direction from the actuator member toward the main peripheral wall wherein the cap assumes first, second, and third positions;

wherein in the first position the wall portion is in a first deflected state and the actuator arm is deflected to an actuating position;

wherein in the second position the wall portion is in a second deflected state in which the wall portion is deflected less than in the first deflected state and the actuator arm is in a non-actuating position;

wherein in the third position both the wall portion and the actuator arm are in an undeflected state.

15. The cap of claim 14, wherein in the non-actuating position the arm is deflected less than in the actuating position.

16. The cap of claim 14, wherein in the non-actuating position the arm is not deflected at all.

17. The actuator cap of claim 14, further comprising an additional deflectable actuator arm.

18. The actuator cap of claim 17, further comprising another deflectable actuator arm.

19. An actuator cap for a container of product, comprising:

a main body having a flexible region that is radially deflectable toward an axial centerline of the cap wherein the flexible region deflects in response to a first force to a first extent and in response to a second force greater than the first force deflects to a second extent greater than the first extent;

a centrally disposed actuator member oriented to discharge product axially; and an actuator arm extending radially from the actuator member in a direction from the actuator member toward the flexible region wherein the actuator arm deflects to an actuating position in response to the second force but does not deflect to an actuating position in response to the first force.

20. The cap of claim 19, wherein the actuator arm deflects in response to the first force but deflects to a lesser extent than the actuating position.

21. The cap of claim 19, wherein the actuator arm does not deflect in response to the first force.

22. The cap of claim 19, wherein the cap includes a first end secured to a container of pressurized product and a second end opposite the first end.

23. The cap of claim 22, wherein deflection of the flexible region to the second extent must occur for the actuator arm to deflect to the actuating position thereof to discharge product from the container.

24. The cap of claim 19, wherein the actuator arm extends laterally outside the cap.

25. The cap of claim 23, wherein the second force is applied for a period of time and wherein during the period of time the second force is initially applied to the flexible region and upon deflection of the flexible region to the second extent the second force applies to the actuator arm deflecting the actuator arm to the actuating position thereof.

26. An actuator cap for a container of product, comprising:

a main peripheral wall surrounding a central discharge member wherein the central discharge member is oriented to discharge product axially;

an actuator arm extending radially from the central discharge member and axially deflectable to axially displace the central discharge member;

a pillar having a peripheral surface and radially deflectable toward the central discharge member and wherein the pillar is deflectable relative to the main peripheral wall;

wherein in an actuating position of the central discharge member both the pillar and the actuator arm are deflected; and wherein in a non-actuating position an outermost surface of the arm is flush with the peripheral surface of the pillar.

* * * * *